US005150845A

United States Patent [19]

Colli et al.

[11] Patent Number: 5,150,845

[45] Date of Patent: Sep. 29, 1992

[54] DEVICE AND METHOD FOR AUTOMATICALLY CONNECTING THE YARN TO THE TUBE OF A WINDING MACHINE

[75] Inventors: Luigi Colli; Roberto Badiali, both of Pordenone, Italy

[73] Assignee: Savio S.p.A., Pordenone, Italy

[21] Appl. No.: 764,980

[22] Filed: Sep. 23, 1991

Related U.S. Application Data

[63] Continuation-in-part of Ser. No. 483,320, Feb. 21, 1990, abandoned, which is a continuation-in-part of Ser. No. 155,211, Feb. 12, 1988, abandoned.

[30] Foreign Application Priority Data

Feb. 27, 1987 [IT] Italy ..... 19509 A/87

[51] Int. Cl.[5] ..... B65H 67/04

[52] U.S. Cl. ..... 242/35.5 A; 242/18 PW

[58] Field of Search ..... 242/35.5 A, 35.5 R, 242/35.6 R, 18 PW, 18 R, 18 A; 57/268, 269, 270, 276, 278

[56] References Cited

U.S. PATENT DOCUMENTS

| | | | |
|---|---|---|---|
| 3,857,523 | 12/1974 | Lendermann | 242/18 PW |
| 3,940,077 | 2/1976 | Ohashi | 242/35.5 A |
| 3,942,731 | 3/1976 | Lattion | 242/18 PW |
| 4,141,513 | 2/1979 | Miller | 242/18 PW |
| 4,591,105 | 5/1986 | Niederer | 242/18 PW X |

FOREIGN PATENT DOCUMENTS

| | | |
|---|---|---|
| 0126352 | 11/1984 | European Pat. Off. . |
| 1203566 | 10/1965 | Fed. Rep. of Germany . |
| 3435951 | 4/1986 | Fed. Rep. of Germany . |
| 2552745 | 5/1985 | France . |
| 2001362 | 1/1979 | United Kingdom . |

*Primary Examiner*—Stanley N. Gilreath
*Attorney, Agent, or Firm*—G. P. Hoare, Jr.

[57] ABSTRACT

A device and method for automatically connecting the yarn to the tube of a winding machine, comprising yarn manipulation members grouped on a single arm which rotates in two mutually orthogonal planes, the member for initiating tube rotation consisting of a belt which runs between two pulleys. The yarn is connected while keeping the already formed bobbin in a waiting position until yarn connection is completed.

6 Claims, 12 Drawing Sheets

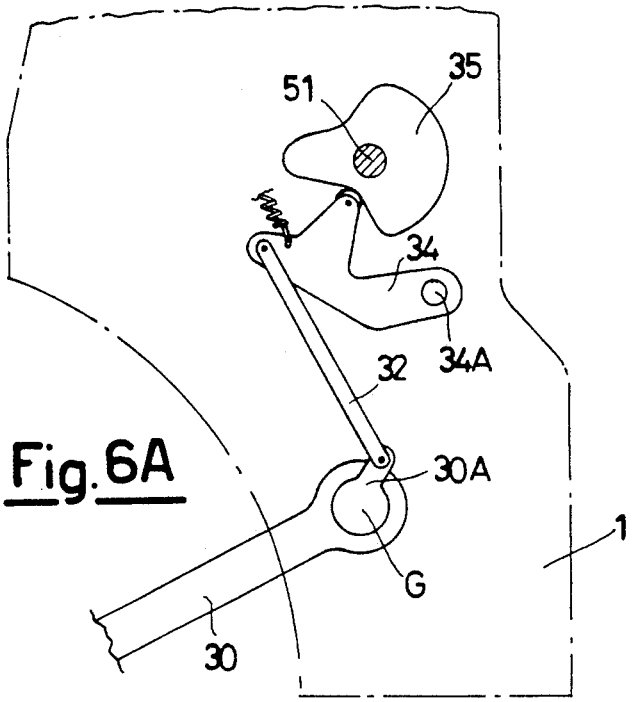
Fig.6A
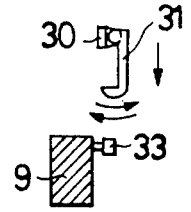
Fig.7A
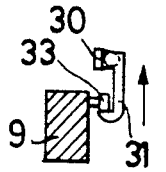
Fig.7B
Fig.6B
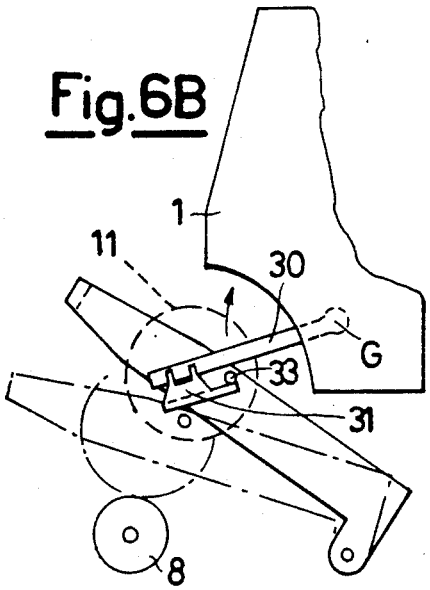
Fig.6C
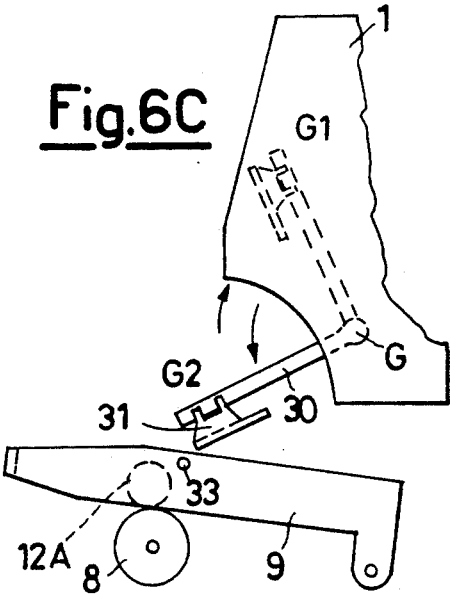

Fig.15
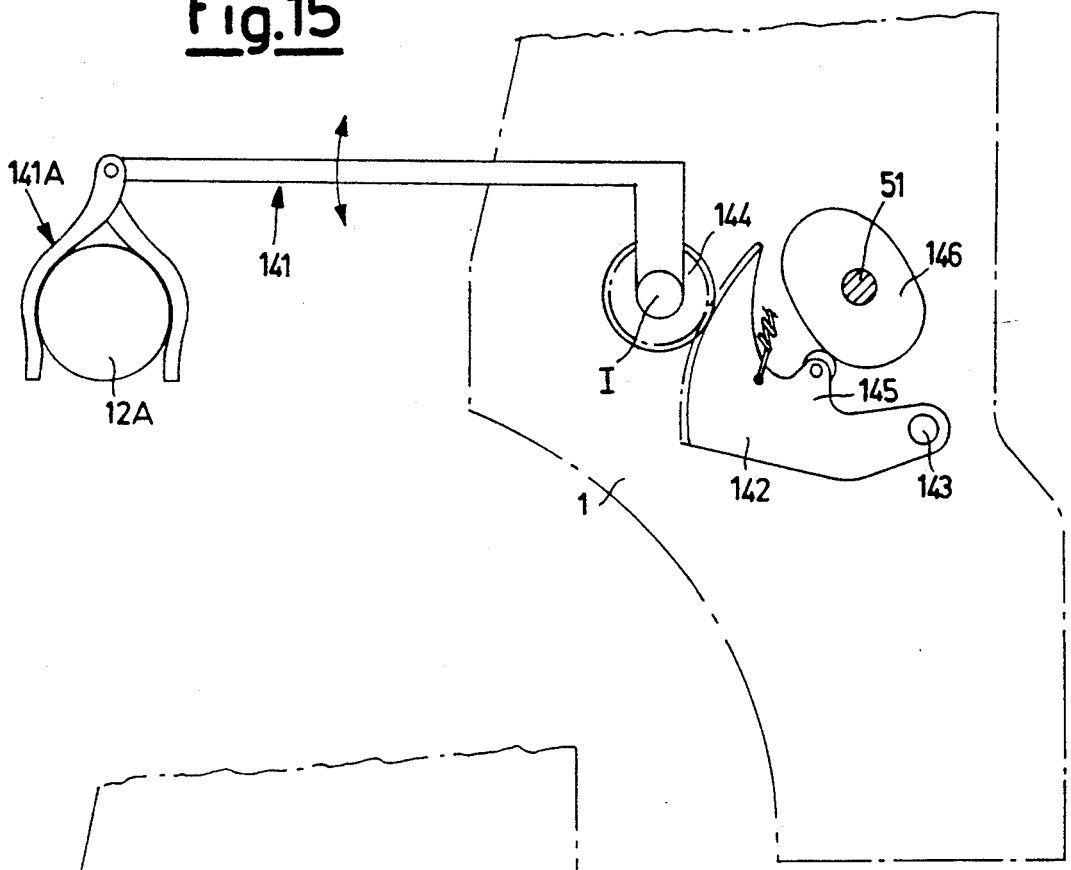
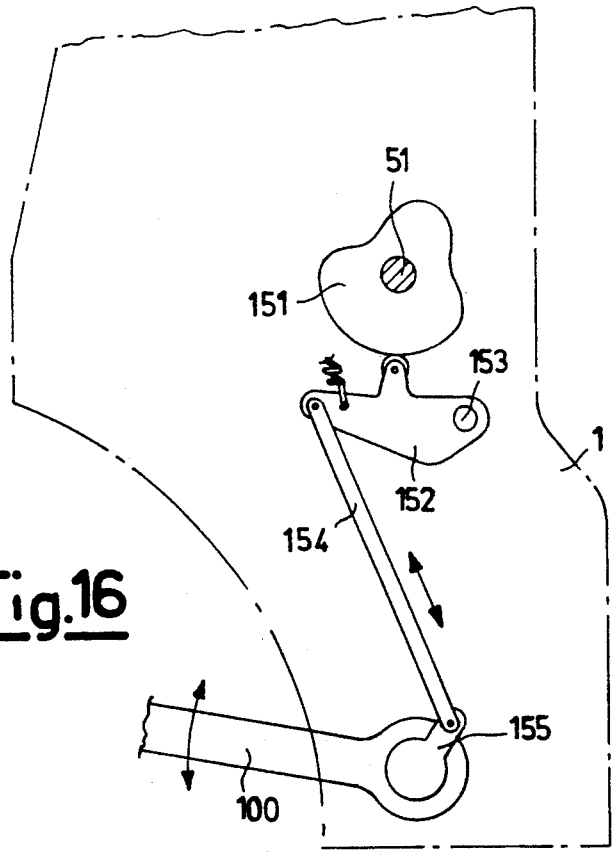
Fig.16

DEVICE AND METHOD FOR AUTOMATICALLY CONNECTING THE YARN TO THE TUBE OF A WINDING MACHINE

This application is a continuation-in-part of application Ser. No. 07/483,320 filed Feb. 21, 1990, now abandoned which is a continuation-in-part of application Ser. No. 07/155,211 filed Feb. 12, 1988, now abandoned.

This invention relates to a device and method for automatically connecting the yarn to a new tube on the bobbin support arm of a winding machine.

Winding machines are known to consist of a plurality of winding heads, each of which automatically performs the winding operation, which in its essential lines consists of withdrawing the yarn from supply packages, eliminating its defects and then winding it onto tubes to form bobbins of a predetermined size. When the bobbin under formation reaches the required size, the winding head is halted, the bobbin is discharged and must be replaced by a new tube on which a new bobbin is to be formed. As winding machines consist of a large number of winding heads, for example an average of 48–60 heads in straight-line winding machines, it is advantageous for this operation to be performed automatically as a large number of positions may need to undergo the replacement operation within a short time period.

This operation is commonly known as doffing, and consists of releasing and discharging the full bobbin, and replacing it with a new tube.

The device according to the invention allows the implementation of a new method for connecting the yarn to the tube, and this also forms part of the present invention.

In its essential lines the device for connecting the yarn to the new tube comprises a member for seizing the yarn from the discharged bobbin, a member for cutting the yarn, a member for positioning the yarn on the new tube, and a member for wrapping the yarn about the new tube.

A typical embodiment of the invention is described in detail hereinafter with reference to the figures, of which:

FIG. 1 schematically shows a partial side view of the discharge of the full bobbin;

FIG. 2 is a full orthogonal view of some parts of the device;

FIG. 3 schematically shows a partial front view of the yarn cutting member;

FIGS. 4A and 4B schematically show side views of the wrapping of the yarn about the new tube, and FIG. 5 shows a partial orthogonal view of the wrapping of the yarn about the new tube;

FIGS. 6A, 6B, 6C schematically show the means for controlling the raising and lowering of the bobbin support arm;

FIGS. 7A and 7B show a cross section of said arm and the means for engaging and raising the arm;

FIGS. 8A and 8B respectively show a plan view and a partial elevational view of the means for controlling a movable centering support for the tubes on which the bobbins are wound;

FIG. 15 is a schematic view of the means for controlling a feeding member for the empty tubes;

FIG. 16 is a schematic representation of the means for controlling the movement of the arm carrying the yarn wrapping means;

The device according to the invention can be provided either for fixed positioning, or for mobile positioning—which constitutes its preferred embodiment—by supporting part of the device on one or more mobile carriages which patrol along the machine face to serve the winding heads as and when they require this operation. The illustrative figures accompanying the description relate to the device having parts supported on a carriage.

Figure 1:
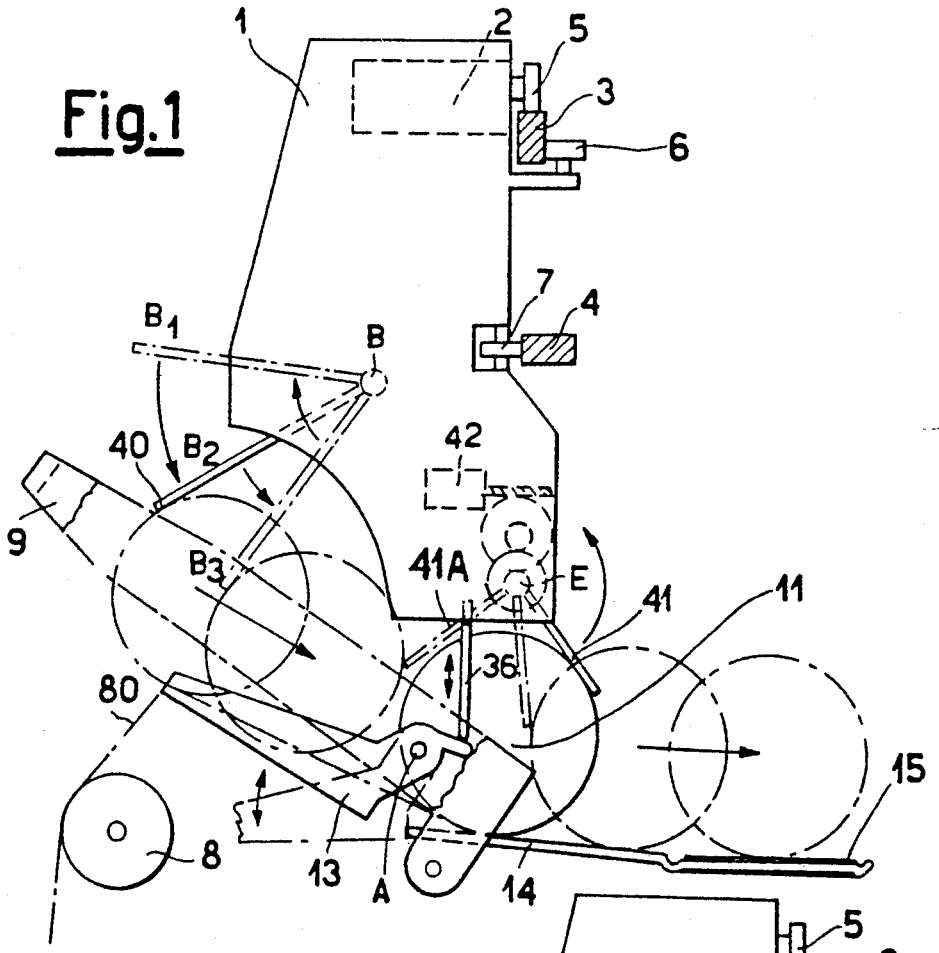

In FIG. 1, mobile carriage 1 is motorised by the electric motor 2 and runs along the fixed rails 3 and 4 extending along the machine face. The carriage 1 is driven by the drive wheel 5 connected to the motor 2, and is restrained by the idle wheels 6 and 7 which run along the rails 3 and 4 to exactly determine the position of the carriage 1 in the plane of the figure, in known manner.

The carriage 1 can also advantageously act as a support for other winding head service devices, such as for doffing the bobbins or for other operations.

The winding head is shown diagrammatically in the figures by means of its more important elements such as the bobbin drive roller 8 and the bobbin support arm 9.

Figure 8A:
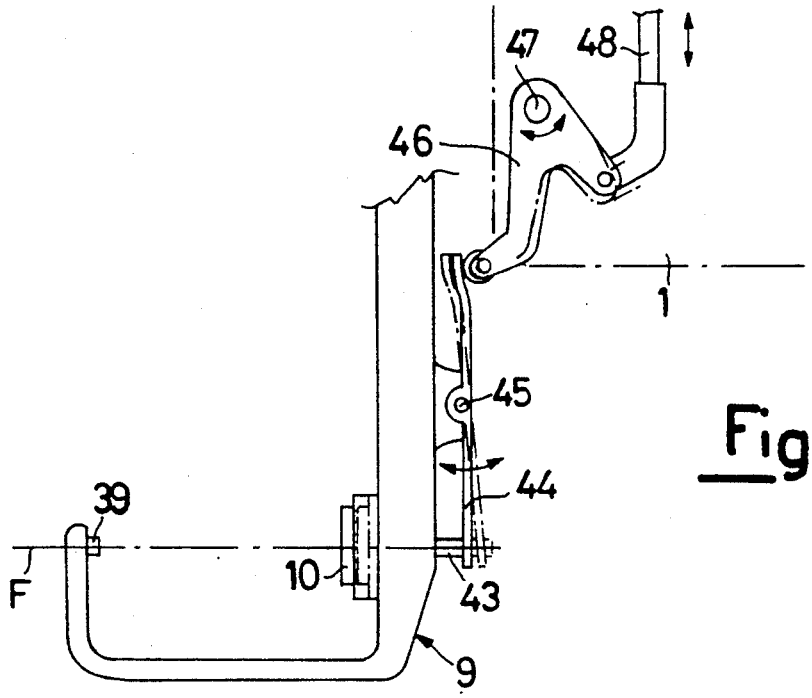
Figure 8B:
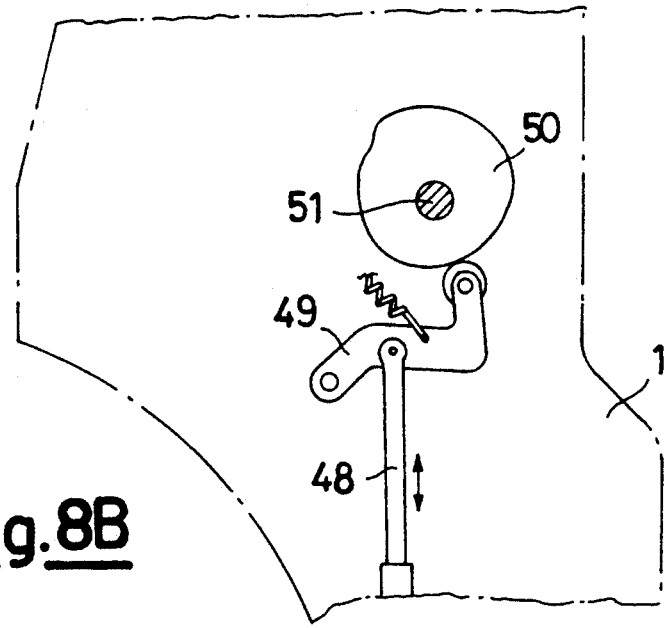

In the most common types of winding machine, the bobbin support arm 9 carries at its ends two holding centres 10 and 39, of which at least one, indicated by 10, is mobile in an axial direction. Members 10 and 39 represent two opposite centering protrusions for the empty tubes on respective portions of the pivotal arm 9. One of the protrusions (10) is also axially displaceable along an axis F indicated by dashed and dotted lines in FIG. 8A. This represents the rotational axis of the bobbin, as is known in the art. Such a support means for rotatably holding empty tubes on which yarn is to be wound is known, for example by Lattion in U.S. Pat. No. 4,598,881. Movements of the centering member 10 apart and toward the centering member 39 may be carried out by means of a cam having such a variable profile to approach and withdraw the axially displaceable member 10 in cooperation with a bias spring opposing withdrawing movements. These means have been represented in FIGS. 8A and 8B of the drawings, but they are well known in the art.

The holding center 10 is rotatably carried by a pin 43 slidingly mounted in the arm 9 to move axially along the axis F. A spring (not shown) urges the pin 43 and the center 10 in the direction toward the center 39. A lever 44 pivoted to the arm 9 at 45 has one end engaging the pin 43 and another end engaging a follower wheel on an angled lever 46 pivoted at 47 on the carriage 1; The lever 46 is caused to rock by a control rod 48 which is pivoted to a cam follower member 49 engaging a cam 50 mounted on a cam shaft 51 rotatably carried in the carriage 1. It is apparent that on rotating the cam shaft 51 a timed control of the lever 44 and therefore of the axial displacement of the holding center 10 is achieved, which approaches to, or withdraws from, the holding center 39. These holding centres are thus made to approach and withdraw from each other to respectively clamp the tube while leaving it free to rotate about its axis, and release it for the doffing and replacement operations.

Generally, the bobbin doffing and replacement sequence is as follows:

the winding head is halted
the bobbin support arm is raised
the finished bobbin is doffed
the new tube is loaded
the yarn is connected to the new tube
the bobbin support arm is lowered
the winding head is restarted.

The present invention relates to the connection of the yarn to the tube and has certain implications for the doffing of the full bobbin, from which the yarn to be connected to the new tube has to be seized and retained.

The bobbin support arm 9 is and remains raised—by the action of members shown in FIGS. 6A, 6B, 6C and 7A, 7B—during the doffing operation.

These members include an arm 30 pivoted at one end at G to the carriage 1 and provided near the other end with a spring hook 31. The arm 30 is pivotally controlled between positions G1 and G2 by a control rod 32 having one end pivoted to a protrusion 30A rigid with the arm 30 and another end pivoted to a cam follower member 34 pivoted at 34A to the carriage 1 and engaging a cam 35 fastened to the cam shaft 51 in the carriage 1.

When the arm 30 descends from the rest position G1 to the operative position G2 the hook 31 firstly abuts against a roller 33 fixed on the support arm 30 and then rotates anticlockwise (FIG. 7A) until it overrides the roller 33 and on rotating clockwise engages the roller 33 (FIG. 7B). Subsequently the arm 30 is raised owing to the profile of the rotating cam 35 into the position shown in FIG. 6B and drags the arm 9 into the raised position for discharging the full bobbin 11.

It is to be noted that in the position G2 the hook 31 engages the roller 33 when the arm 9 carries a full bobbin and is thus in a higher position (as shown with dashed lines in FIG. 6B), whereas the hook 31 leaves the roller 33 free (as shown in FIG. 6C) when the arm 9 carries an empty tube 12A and thus rests in a lower position.

Figure 9:
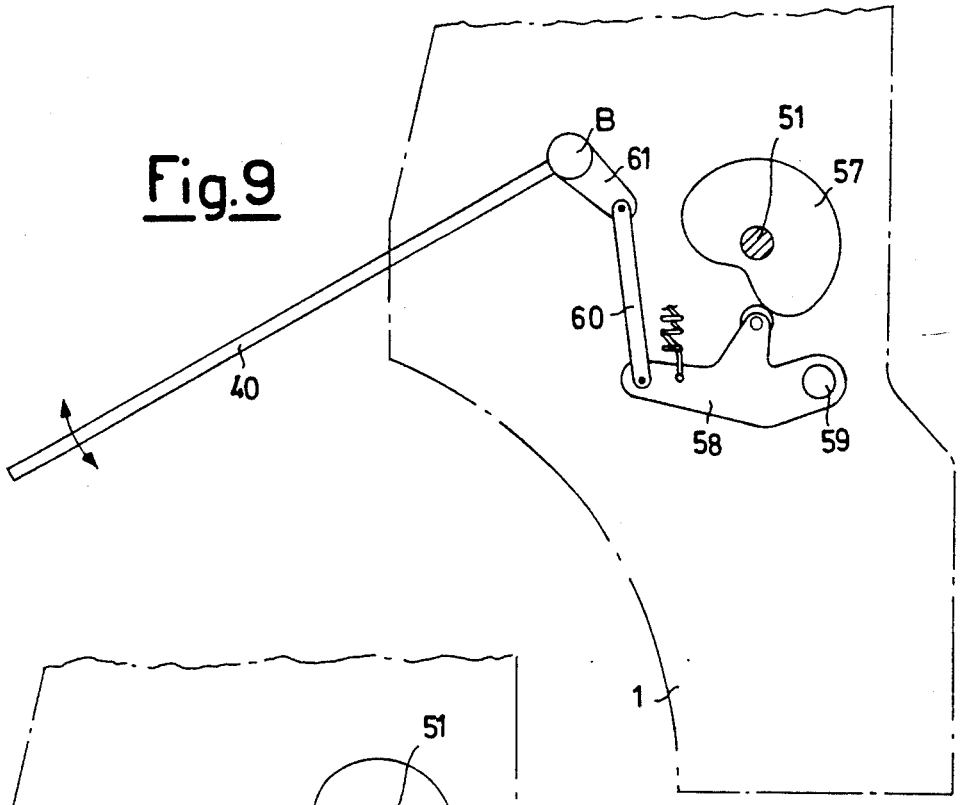
FIG. 9 is a schematic representation of the means controlling a bobbin dragging arm operative during bobbin discharge.
Figure 10:
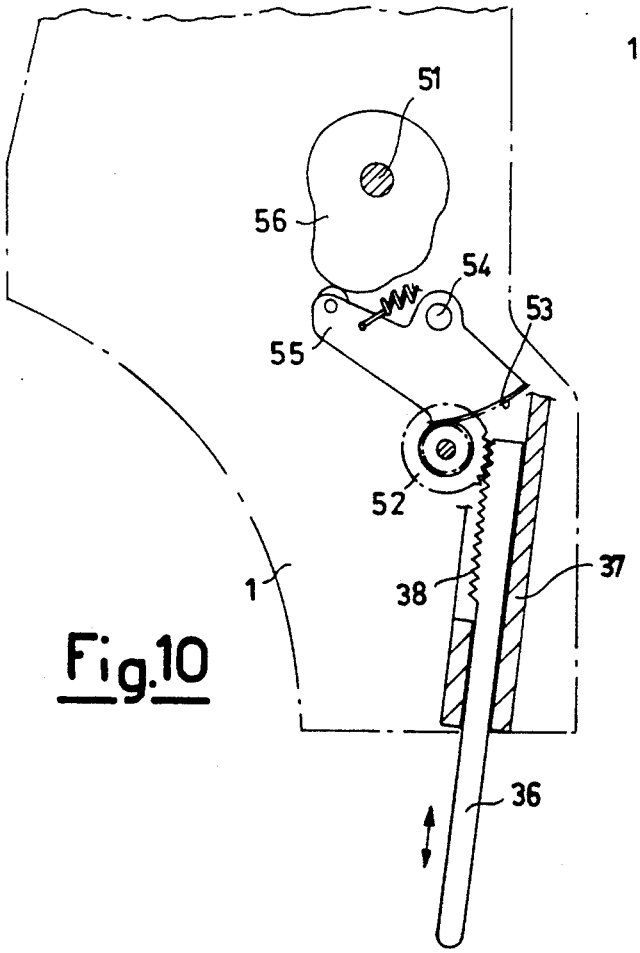
FIG. 10 is a schematic view of the means for controlling the position of a movable bobbin discharge chute.

The full bobbin 11 is released by the mobile holding centre 10 and fixed holding centre 39, which move apart, and falls onto the mobile chute 13 which is raised by the piston 36 disposed on the carriage 1. Piston 36 moves downwardly, contacting the chute 13 and causing it to pivot in clockwise direction about fulcrum A. Piston 36 is guided in a guide 37 (FIG. 10) in the carriage 1 and comprises a toothing 38. The toothing 38 meshes with a gear wheel 52 rotatably supported in the carriage 1. The gear wheel 52 engages a toothed sector 53 pivoted at 54 to the carriage and following with a protrusion 55 the profile of a cam 56 rigid on the cam shaft 51. Rotation of the cam 56 thus causes timed axial movement of the piston 36 and, as a consequence thereof, pivotal raising and lowering of the chute 13. The bobbin 11 then proceeds along the fixed chute 14 towards the conveyor belt 15, which slides along the winding machine to receive the full bobbins. Because of the taper of the bobbins, their correct rolling towards the belt 15 can be assisted by the pivot-mounted levers 40 and 41, the former accompanying and the latter guiding the bobbin. Simultaneously with the raising of the chute 13, the lever 40 rotates about pivot B from position B1 to position B2 and B3 with the purpose of accompanying the bobbin 12 along the chute 13, while the lever 41 rotates about pivot E into the position 41A shown by dashed lines, in order to first halt the released bobbin 12 along the chute 13 and then guide it gradually towards the belt 15 by rotating in anti-clockwise direction about pivot E. Rotation is controlled by a motor 42. Lever 40 serves to displace the full bobbin 11 along the moveable chute 13 which is raised in an inclined position by member 36. The full bobbin, when released by the centering members 10 and 39 on the raised chute 13, would rotate owing to its conical shape against the edges of the chute 13 and would become positioned along the chute instead of remaining transverse thereto. Arm 40 drags the full bobbin forward on the chute 13 by rotating counterclockwise as shown in the drawings (FIG. 1) until the bobbin is caused to be stopped by arm 41 in its waiting position 41A. The latter arm is rotated and the bobbin progressively reaches the second chute 14 owing to the inclination of the chute 13. The bobbin is then urged towards the conveyor 15 upon completion of the rotation of the arm 41. Rotational actuation of the arms 40 and 41 may apparently be effected by known mechanical means, for instance by gear means operated by electrical motors with interposition of clutch means. As an alternative, shown in FIG. 9, the movement of the arm 40 may be controlled by a cam 57 fastened to the cam shaft 51. The cam 57 is followed by a follower member 58 pivoted to the carriage at 59 and having a free end pivotally connected to one end of a rod 60 which has its opposite end pivoted to an arm 61 rigid with the lever 40.

The levers 40 and 41 are preferably of L-shape and make contact with the bobbin 11 by means of that portion of the L which is perpendicular to the plane of FIG. 1.

This arrangement allows correct discharge of the bobbin—even for high taper—which guided in this manner does not lie crosswise on the path of the chutes 13 and 14.

According to a modified embodiment, the lever 41 can be formed in such a manner as to make a complete anticlockwise revolution about its pivot E, so as to firstly retain the bobbin 11 and then accompany it towards the belt 15, this being advantageous if the bobbin has difficulty in proceeding along the chute 14. When the bobbin 11 has been raised from the holding centres, a new tube 12A is fed and loaded onto the bobbin support arm 9.

In order to be able to resume winding with the new tube 12A, the yarn originating from the winding head must be seized and controlled during the doffing operation.

Figures 2, 3:
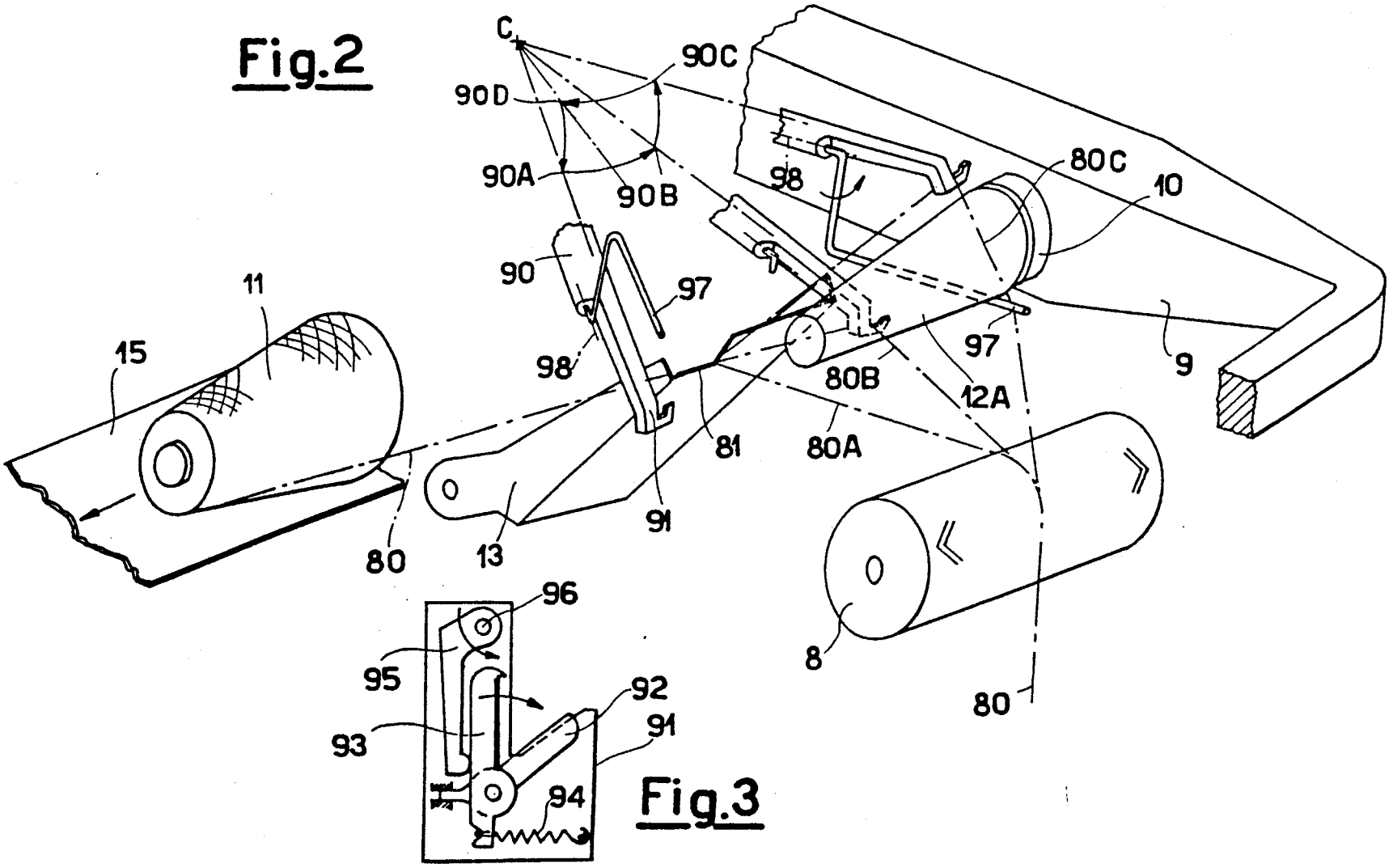

For this purpose the arm 90 is used, it being pivoted at C and able to rotate in two substantially orthogonal planes. Movement of the arm 90 is indicated in FIG. 2, in that some positions of the arm 90 are indicated by a partial representation of the arm itself and by indication of its axis in said positions, as well as by arrows indicating rotation, which occurs about center C. Pivotal movement of the arm 90 may be controlled by an electric motor and reduction gear, but any other suitable means could be used.

A preferred embodiment of the arm 90 and of the means for controlling movement of the arm and of members associated therewith is shown in FIGS. 11 to 14.

The arm 90 is pivotally supported by a fork member 105 the ends 105A and 105B whereof are rotatably supported respectively on hollow bearing members 106 and 107, which are fastened to the carriage 1, so that the fork member 105 is pivotable about an axis H extending horizontally and in the lengthwise direction of the carriage 1, i.e. in the direction parallel to the rails 3 and 4 on which the carriage 1 travels. For supporting the arm 90 the fork member 105 has a protrusion 108 receiving a vertical pin 109 to which the end of the arm 90 is fastened. The axis of the pin 109 passes through the axis H so that the arm 90 is pivotable about center C both horizontally and vertically. The horizontal movement is indicated in FIG. 3 by the arrow between positions 90A and 90B in the one direction and by the arrow between positions 90C and 90D in the other direction. The vertical movement is indicated by the arrow between positions 90D and 90A in the lowering direction and by the arrow between positions 90B and 90C in the raising direction.

Figure 11:
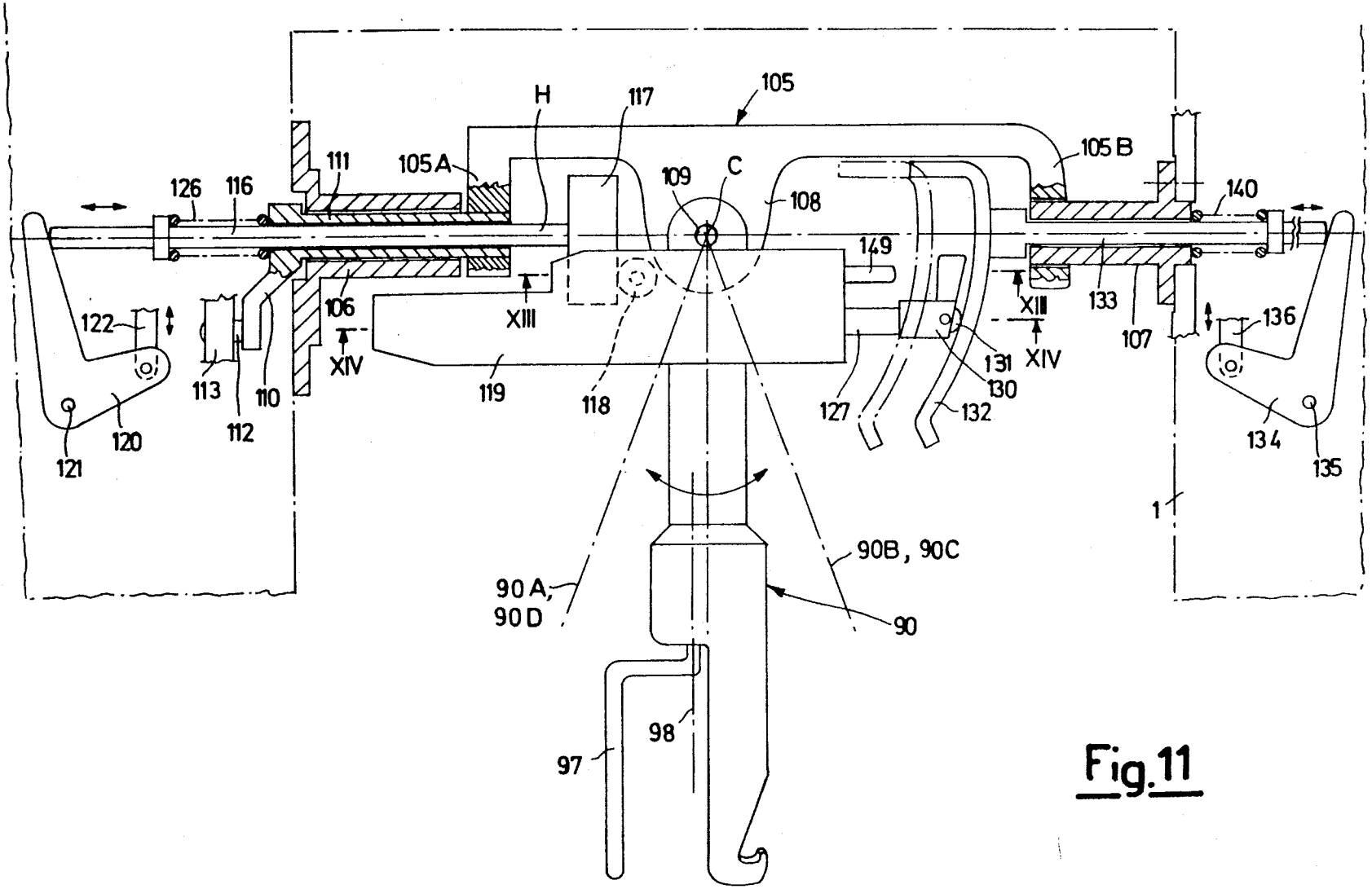
FIG. 11 is a plan view, with some parts represented in section, of the arm engaging and guiding the yarn during bobbin change and of the means for operating the arm and the elements associated therewith.
Figure 11A:
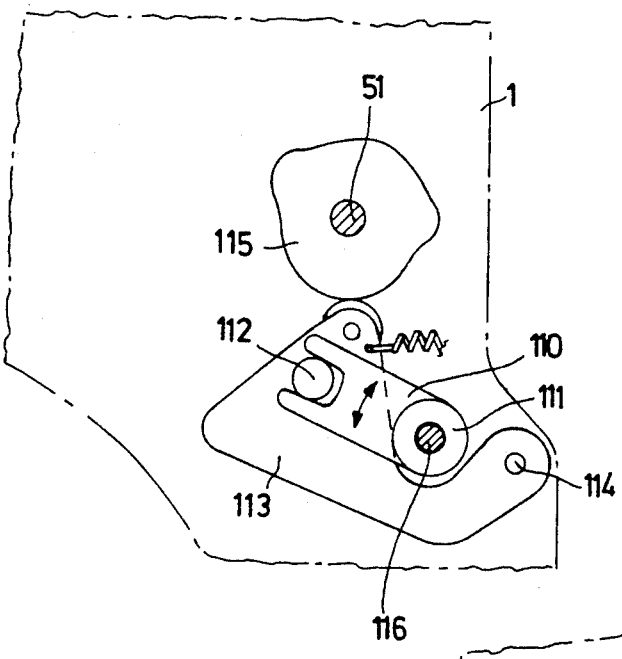
FIG. 11A shows schematically the means for causing pivotal movement of the yarn engaging and guiding arm in a vertical plane.

Pivotal movement of the arm 90 in the vertical direction is performed by an arm 110 rigid with a sleeve 111 which is housed coaxially and rotatably in the bearing 106 and is also rigid with the end 105A of the fork member 105. The arm 110 has a forked end receiving a peg 112 (FIG. 11A) protruding from a follower member 113 pivoted at 114 to the carriage 1. The member 113 engages a cam 115 rigid on the cam shaft 51. Rotation of the cam 115 thus causes the arm 110 to perform a rocking movement which results in a pivotal movement of the fork member 105 about the axis H and therefore in said movement of the arm 90 between positions 90D–90A or 90B–90C.

Figure 11B:
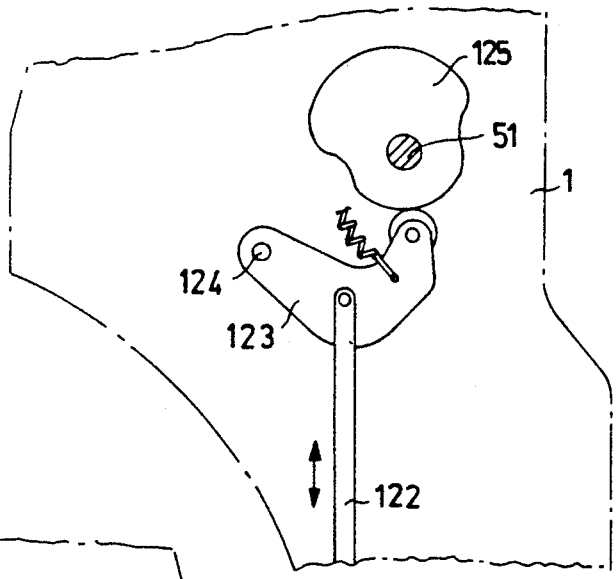
FIG. 11B shows schematically the means for controlling to pivotal movement of the yarn engaging and guiding arm in a horizontal plane.

The horizontal pivotal movement of the arm 90 is performed by an axially slidable bar 116 carrying at one end a piston member 117 engaging a roller 118 protruding from a body 119 extending transverse on the arm 90 and rigid therewith. The other end of the bar 116 is engaged by one end of a rocking lever 120, pivoted at 121 to the carriage 1 and having the other end linked to one end of a control rod 122. This rod 122 has its other end pivotally connected to a cam follower member 123 (FIG. 11B), pivoted at 124 to a fixed part of the carriage 1 and following the profile of a cam 125 rigid with the cam shaft 51. Rotation of the cam 125 thus causes the timed axial movement of the bar 116 and therefore the pivotal movement of the arm 90 horizontally. A spring not shown provides for returning the arm 90 to the position on the left in FIG. 11, i.e. maintains the engagement between the piston member 117 and the roller 118. A spring 126 maintains engagement between the bar 116 and the rocking lever 120. During the sliding of the bobbin 11 along the chute 13 the yarn 80 is still connected to the bobbin, and forms an angle with the upper edge of the chute 13, which is shaped with a lead-in notch 81 for the yarn, which passes through the position 80A. The lever 90 is provided with a hook-shaped end part 91.

Said end part 91 is provided with a cutting device shown in FIG. 3.

The cutting device consists of a fixed cutter 92 and a mobile cutter 93 which are pivoted together to form a scissor member. Said scissor member comprises a return spring 94, which tends to keep it open, and is operated by a lever 95 controlled by the rotating rod 96 which passes along the body of the arm 90.

Said arm 90 is further provided with an L-shaped introduction member 97 able to rotate about the axis 98, substantially parallel to the arm 90 and the rod 96.

Figure 11C:
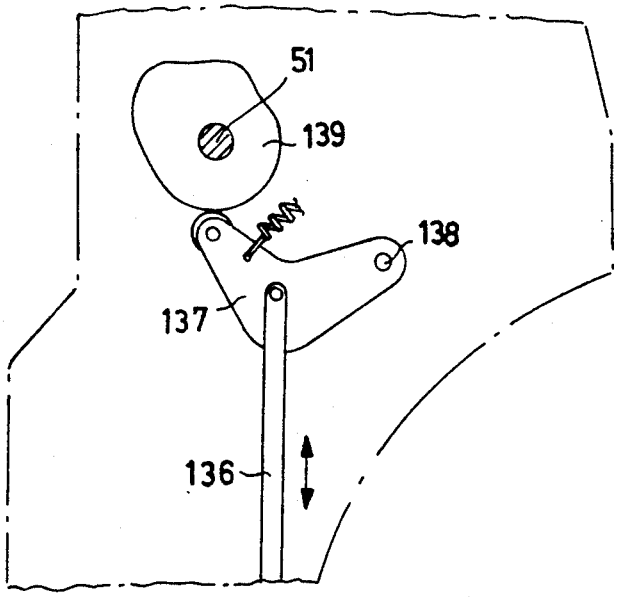
FIG. 11C is a schematic representation of the means controlling movement of some elements associated with said arm.
Figure 12:
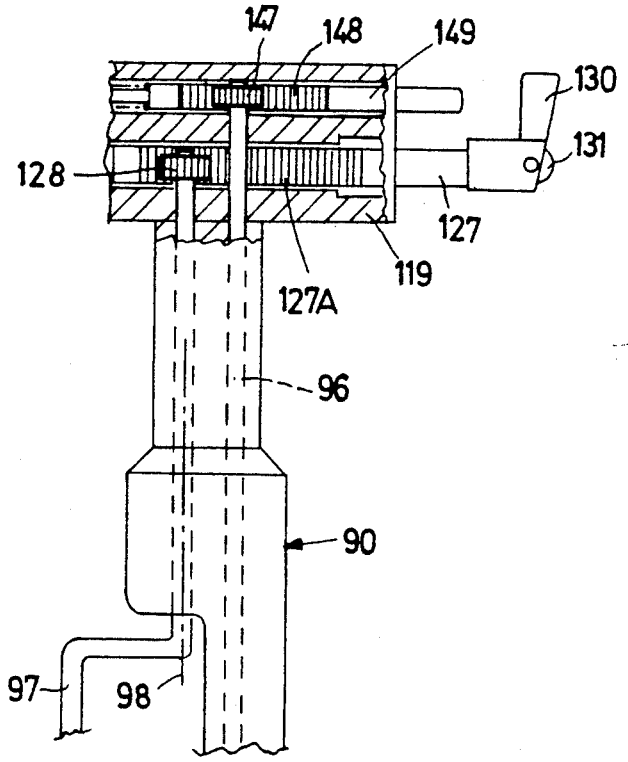
FIG. 12 is a partially sectional plan view of the yarn engaging and guiding arm.
Figure 13:
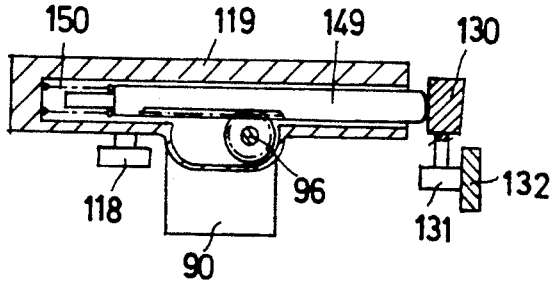
FIG. 13 is a sectional view according to line XIII—XIII of FIG. 11.
Figure 14:
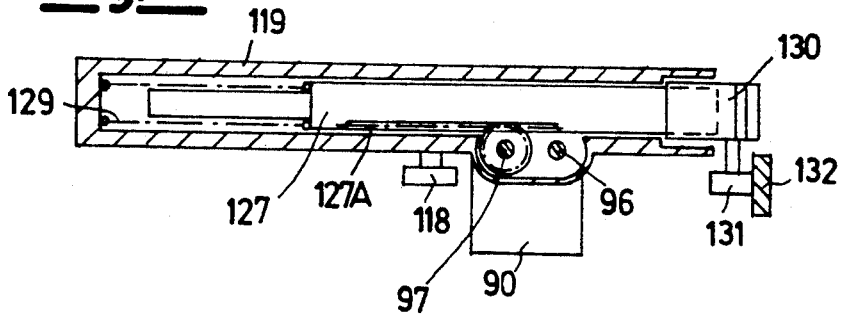
FIG. 14 is a sectional view according to line XIV—XIV of FIG. 11.

The arm 90 undergoes the sequence of rotations indicated by the arrows: it descends from the position 90D into the position 90A in a substantially vertical plane, then rotates in a plane orthogonal to the preceding (and passing through the center C and the axis of the drive roller 8) to reach the position 90B so that the hook-shaped end 91 collects the yarn in the position 80A and moves it into the position 80B, after which the arm 90 rises in a substantially vertical plane into the position 90C, so dragging the yarn into the position 80C. During this operation the introduction member 97 rotates about its axis 98 to move downwards and urge the yarn 80 in front of the holding centre 10. The movement of the member 97 is accomplished by a rack and pinion arrangement as shown in FIGS. 12 and 14. A rod 127 having a rack 127A is slidable lengthwise in the body 119 and the rack 127A meshes with a pinion 128 rigid with the end of the member 97 opposite the end projecting from the arm 90. The rod 127 is urged by a spring 129 to project from the body 119 and carries at its projecting end a cross member 130 to which a follower roller 131 is attached. The follower roller 131 is provided for engaging an arcuate cam member 132 (see also FIG. 11) fastened to one end of a control rod 133 which is slidable coaxially and within the hollow bearing member 107 and which has the opposite end engaged by a rocking lever 134. This lever is pivoted at 135 to the carriage 1 and its rocking movement is controlled by a rod 136 pivoted to the rocking lever 134 at one end and to a cam follower member 137 (FIG. 11C) at the other end. Member 137 is pivoted at 138 to the carriage 1 and follows a cam 139 fastened to the cam shaft 51. The profile of this cam 139 causes the rod 133 to move between the positions shown in FIG. 11 respectively with full and with dashed lines. This movement in combination with that of the arm 90 causes the rod 127 to displace and the rack 127A to rotate the pinion 128 and thus the member 97 during the pivotal movement of the arm 90 between the positions 90A and 90B. A spring 140 maintains engagement between the rod 133 and the lever 134 and brings the cam member 132 back into its rest position.

During the operation of the farm 90 the holding centres are free and are not yet occupied by the new tube 12A. A new empty tube 12 is then brought between the centers 10 and 39 by a feeding gripper member 141 (FIG. 15), pivoted to the carriage at I and having tube gripping pincers 141A at the free end. Such means are known in the art. Movement of the member 141 between a tube catching position (in which the member 141 takes up a tube from a feeding conveyor) to the position between the centers 10 and 39 is accomplished by a toothed sector 142, pivoted at 143 to the carriage 1. The sector 142 meshes with a gear wheel 144 rigid with the member 141 and coaxial with the pivoting axis thereof, and has a portion 145 following the profile of a cam 146 fastened to the cam shaft 51.

The new tube 12A is then positioned, and as its bottom end comes into engagement with the holding centre 10 it clamps the yarn which has previously been moved into the position 80C and grips it when the mobile holding centre 10 closes to lock the bottom end of the tube 12A.

When the holding centre 10 has closed, the cutting device disposed at 91 can be operated. The mobile cutter 93 closes against the fixed cutter 92 to cut the yarn. Cutter 93 is operated by rotation of rod 96 about its own axis. Such a rotation may be performed by a suitable known means provided for causing rotation of a rod. In the embodiment shown in the drawings (FIGS. 12 and 13), the rotation of the rod 96 is accomplished by a rack and pinion arrangement like that controlling member 97. The rod 96 has at its end opposite to that operating the cutter 93, a pinion 147 which meshes with a rack 148 provided on a rod 149 slidable in the body 119 parallel to the rod 127. The rod 149 is urged by a spring 150 to project by a small amount from the body 119.

Operation of the cutter 93 occurs when the arm 90 is in the position 90B. At this time, the cross member 130, controlled by the cam member 132, is approached to the body 119 so that it engages the end of the rod 149 and causes the rod 149 to move against the action of the spring 150, so that a rotation is given to the pinion 147 and the cutter 93 is caused to perform the cutting movement. Of the two yarn tail ends, the end towards the roller 8 is released (it being retained by the holding centre 10) whereas the end towards the bobbin is retained between the two cutters so that it does not interfere with the tube 12A during the yarn connection. The arm 90 remains in the position 90C.

Figure 4A:
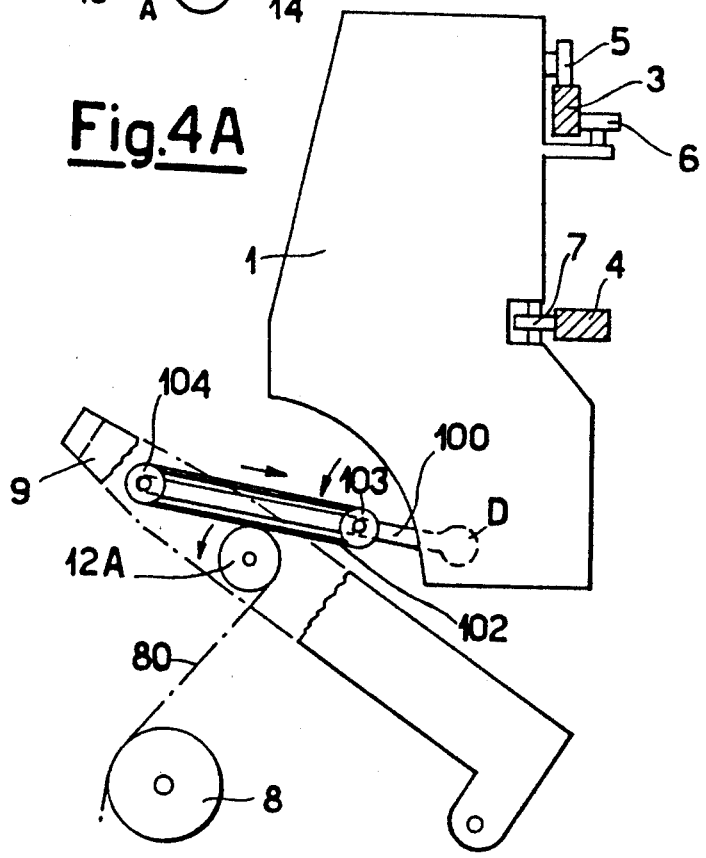
Figure 4B:
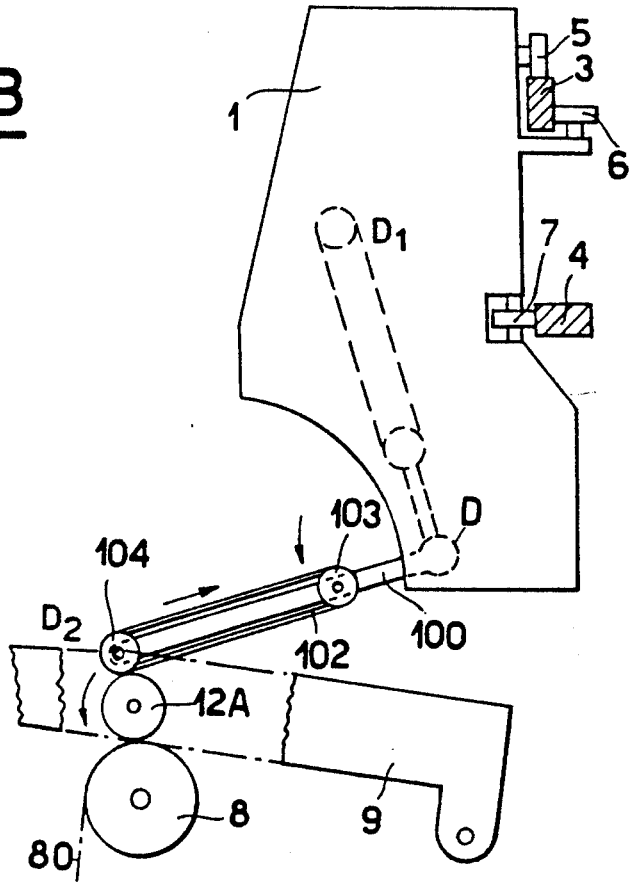
Figure 5:
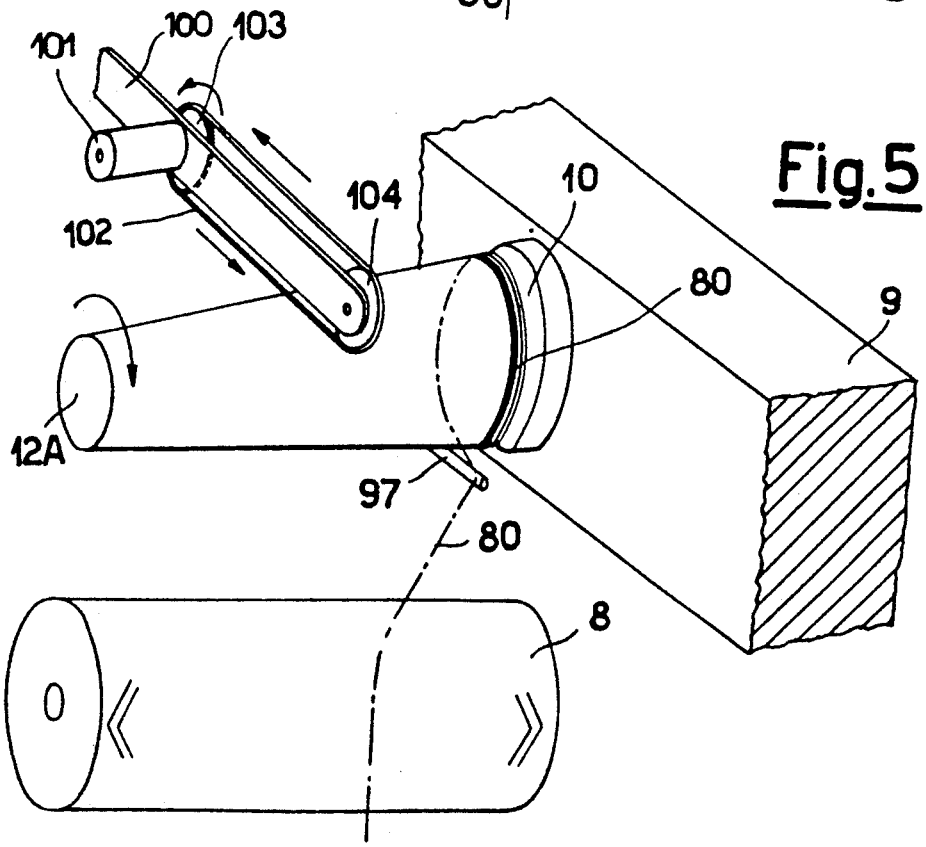

The arm 100 is now lowered from position D1 to position D2 (FIG. 4B), this being pivoted on the carriage 1 by means of the pin D so that it rotates in a plane substantially orthogonal to the axis of the tube 12A and is provided with a motor 101 driving the belt 102 which extends between the drive pulley 103 and driven pulley 104. Movement of the arm 100 is caused by a cam 151 (FIG. 16) fastened to the cam shaft 51. The cam 151 is engaged by a cam follower member 152 pivoted at 153 to the carriage 1. The free end of member 152 is pivotally connected to a rod 154 pivotally linked to a projection 155 rigid with the arm 100. The belt 102 driven by the motor 101 is brought by the arm 100 into engagement with the tube 12A so making it rotate in the direction of the arrow and collect the yarn 80 in the form of closely adjacent turns on the bottom end of the tube according to the position of the introduction member 97. The number of turns wound depends upon the time of operation of the motor 101. Driving the tube 12A by means of the belt device is very advantageous in that it can drive the tube for any position of the bobbin support arm 9—as shown in FIG. 4A and FIG. 4B—and its contact is very delicate such that it cannot damage the tube.

When the yarn has been connected, the arm 100 returns to its rest position D1 and winding can be resumed.

According to a preferred embodiment of the invention, the full bobbin to be discharged is retained on the discharge chutes 13/14 by the pivot-mounted lever 41, and its yarn end is retained between the two cutters 92/93 until connection has been completed in order to ensure that this yarn end is controlled at all times and does not become entangled in the machine members, with obvious negative consequences.

Only when yarn connection is complete is the bobbin 11 delivered to the belt 15 and removed.

The arm 90 moves from position 90C into the rest position 90D to disengage the introduction member 97.

The bobbin support arm 9 can now be returned to engagement with the roller 8, and winding is resumed.

Figure 17:
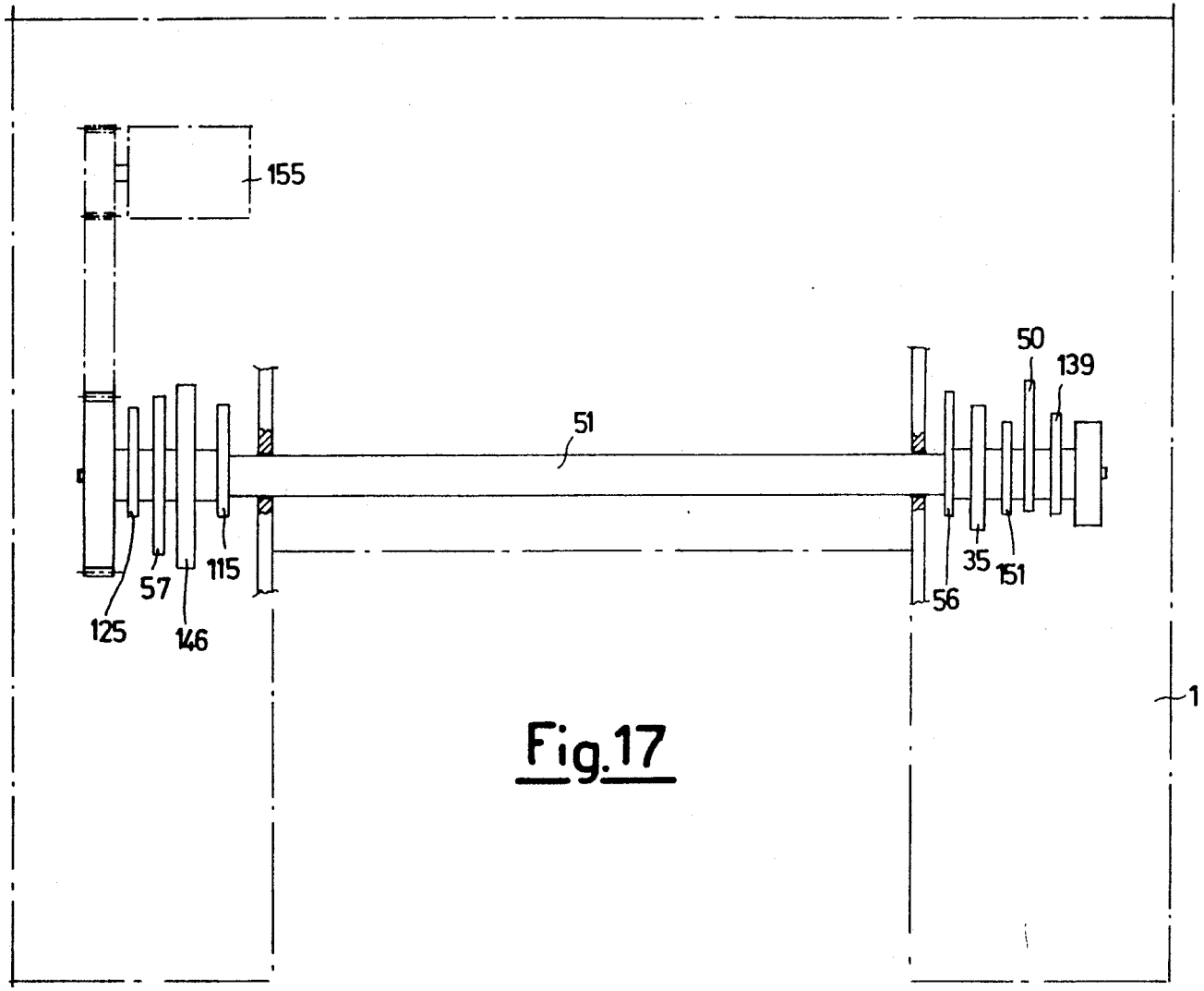
FIG. 17 shows the arrangement of the control cams on the movable carriage.
Figure 18:
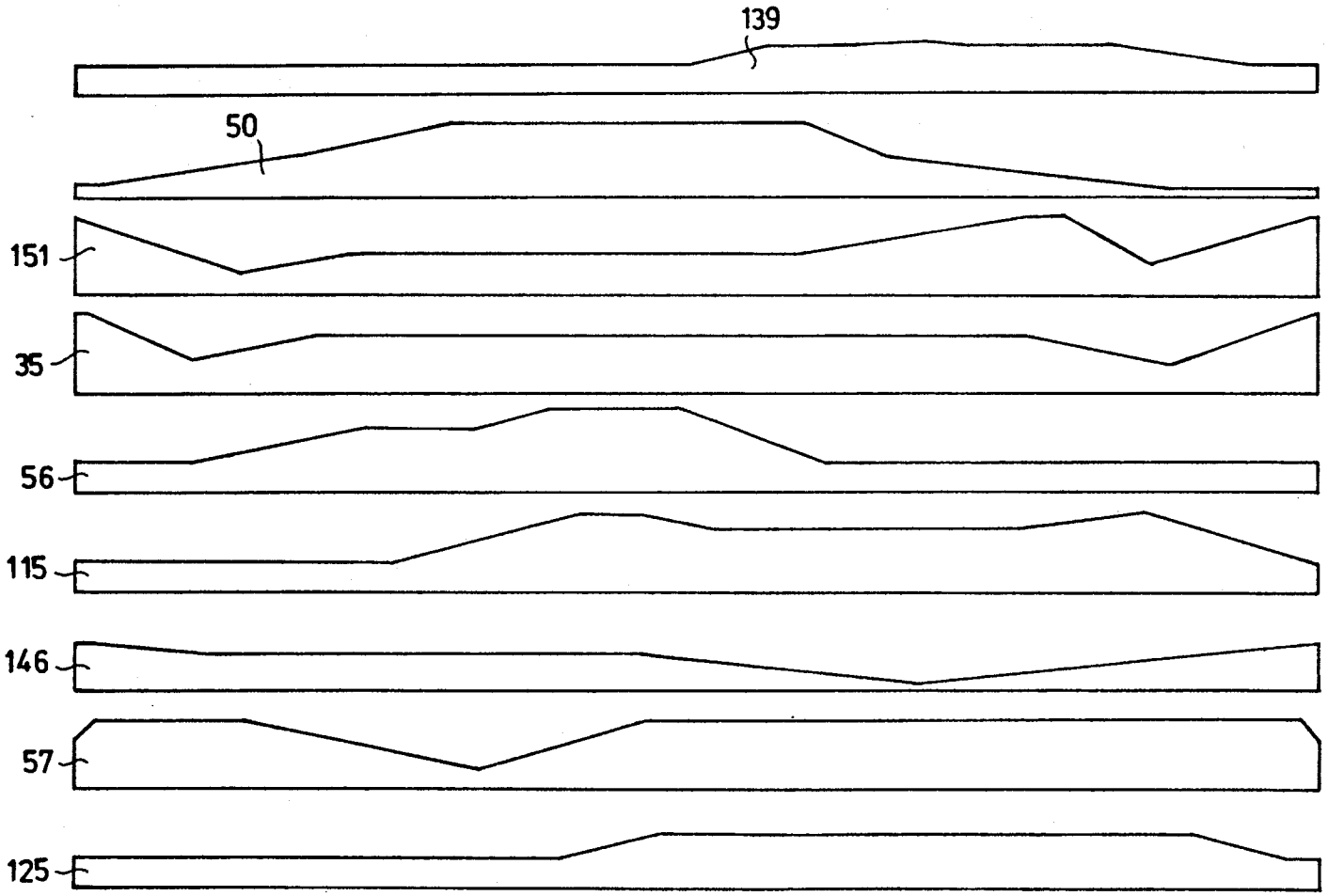
FIG. 18 is a view of the profiles of the cams developed in a plane.

For controlling movements of the various movable elements which do not have its own motor like lever 41, there is provided on the carriage 1 an A.C. motor 155 driving the cam shaft 51 having the described plurality of control cams fixed thereto (FIG. 17), the cams having a contour and mutual angular arrangement such that by slowly rotating they cause movement of the various movable elements in a time sequence to obtain the above described sequential operation of these elements. Control cams of this type are well known in this art. The profile of the cams of the present invention developed in a plane is shown in FIG. 18

We claim:

1. A device for automatically connecting yarn from a bobbin to be discharged, wherein the bobbin is held between a fixed holding center and a mobile holding center on bobbin support arms of a winding machine, to a new tube of said winding machine, and wherein the device has an arm to which members are attached which are able to rotate in two planes which are substantially mutually orthogonal, wherein the device comprises:

a member to seize the yarn connected to said arm of the device to seize the yarn from the bobbin to be discharged; and a member for positioning the yarn connected to said arm of the device for positioning the yarn onto the new tube;

a yarn cutting member connected to said arm of the device to separate the yarn wound to the bobbin to be discharged from the yarn to be connected to the new tube; and a tube rotating member connected to said arm of the device to wind initial turns of the yarn on the new tube including a motor driven belt slidable between two pulleys which are supportable by an arm able to descend in a plane orthogonal to the tube axis to bring said belt into engagement to rotate said tube.

2. The device of claim 1, wherein the device comprises a mobile carriage for patrolling along the winding machine face having winding heads thereon to serve said winding heads of the machine as they require.

3. The device of claim 2, wherein the member for seizing the yarn from the bobbin to be discharged further comprises a hook-shaped end part including a cutting member and an L-shaped introduction member for rotating about said arm and withdraws and brings the yarn of the bobbin to be discharged into a position in front of the mobile holding center of the bobbin support arm for clamping between said holding centers and the bottom end of the new tube.

4. The device of claim 3, further comprising a full bobbin discharge chute attached to the device wherein said chute comprises a yarn lead-in notch from which the yarn gripping member seizes the yarn.

5. The device of claim 4, further comprising pivot-mounted levers attached to the device for accompanying and guiding said full bobbin along said chute.

6. A method of automatically connecting yarn from a bobbin to be discharged, wherein the bobbin is held between a fixed holding center and a mobile holding center on bobbin support arms of a winding machine, to a new tube of said winding machine, comprising the steps of:

seizing the yarn from the bobbin to be discharged by a yarn gripping member means, withdrawing and bringing the yarn of the bobbin to be discharged into a position in front of said mobile holding center of said bobbin support arm, positioning the yarn so that the yarn can be wound onto the new tube by a yarn positioning member means, clamping the yarn between said holding centers and the bottom of said tube, separating the yarn wound on the bobbin to be discharged from the yarn to be connected on the new tube by a yarn cutting member means, winding initial turns of the yarn onto the new tube by a tube rotating member means which includes a motor driven belt slidable between two pulleys which are supported by an arm which is able to descend in a plane orthogonal to the tube axis to bring said belt into engagement to rotate said tube.

* * * * *